US007699089B2

(12) United States Patent
Knutson et al.

(10) Patent No.: US 7,699,089 B2
(45) Date of Patent: Apr. 20, 2010

(54) POWER-OPERATED FOLDING DOOR

(75) Inventors: Perry Knutson, Lancaster, WI (US); Mike Lamey, Bernard, IA (US); Mark Ungs, Dubuque, IA (US); Rodney Kern, Dubuque, IA (US); Bill Hoerner, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 221 days.

(21) Appl. No.: 11/435,952

(22) Filed: May 17, 2006

(65) Prior Publication Data

US 2007/0272370 A1 Nov. 29, 2007

(51) Int. Cl.
*E05D 15/26* (2006.01)
*E05D 15/06* (2006.01)

(52) U.S. Cl. ..... 160/199; 160/196.1

(58) Field of Classification Search ..... 160/199, 160/130, 181, 196.1, 202, 206, 209, 183, 160/118, 119, 193, 126, 113; 49/366, 209, 49/211; 16/282, 302, 366, 49, 87 B
See application file for complete search history.

(56) References Cited

U.S. PATENT DOCUMENTS

| | | | | |
|---|---|---|---|---|
| 2,614,627 | A * | 10/1952 | Miller | 160/199 |
| 3,161,229 | A * | 12/1964 | Sanders | 160/40 |
| 4,276,919 | A * | 7/1981 | Walters | 160/206 |
| 4,387,760 | A | 6/1983 | Greschbach | |
| 4,887,659 | A | 12/1989 | West | |
| 5,295,527 | A * | 3/1994 | West | 160/199 |
| 5,967,160 | A * | 10/1999 | Rochette et al. | 134/200 |
| 6,098,695 | A * | 8/2000 | Schwingle | 160/199 |
| 6,470,952 | B1 * | 10/2002 | Cline et al. | 160/188 |
| 7,155,861 | B2 * | 1/2007 | Berry et al. | 49/225 |
| 2002/0144793 | A1 * | 10/2002 | Olofsson | 160/196.1 |

FOREIGN PATENT DOCUMENTS

EP 0014361 A1 8/1980

OTHER PUBLICATIONS

International Searching Authority, Communication Relating to the Results of the Partial International Search, for counterpart PCT application Serial No. PCT/US2007/066444, mailed on Aug. 31, 2007 (20 pages).

(Continued)

*Primary Examiner*—Katherine W Mitchell
*Assistant Examiner*—Jeremy C Ramsey
(74) *Attorney, Agent, or Firm*—Hanley, Flight & Zimmerman, LLC

(57) ABSTRACT

Two or more panels of a power-operated folding door are supported by a novel articulated arm assembly that ensures that the door closes tightly against a wall-mounted seal and easily opens. The articulated arm assembly includes a connector with two spaced-apart pivot points about which two adjoining arms of the assembly can rotate as the door opens and closes. The two pivot points allow the panels to readily fold up and store more compactly when the door is open. To provide an airtight seal where two leading panels come together at the center of the doorway, one or more control mechanisms coupled to the articulated arm assembly ensure that the leading panels overlap when the door is closed.

14 Claims, 9 Drawing Sheets

OTHER PUBLICATIONS

International Searching Authority, "International Search Report", for counterpart PCT application Serial No. PCT/US2007/066444, mailed Nov. 9, 2007 (7 pages).

International Searching Authority, "Written Opinion of the International Searching Authority", for counterpart PCT application Serial No. PCT/US2007/066444, mailed Nov. 9, 2007 (10 pages).

The International Bureau, "International Preliminary Report on Patentability," issued in connection with counterpart international application No. PCT/US2007/0066444, issued Nov. 17, 2008, mailed Nov. 27, 2008, 11 pages.

* cited by examiner

POWER-OPERATED FOLDING DOOR

FIELD OF THE DISCLOSURE

The present disclosure generally pertains to horizontally translating folding doors and more specifically to a powered drive mechanism for such a door.

DESCRIPTION OF RELATED ART

Folding doors typically comprise one or two series of vertically elongate panels whose vertical edges are pivotally interconnected. The panels are usually supported by a series of trolleys that are driven along an overhead track to open and close the door. The panels fold upon themselves as the door opens and extend across the doorway to close.

With some folding doors, all of the panels fold up and store off to one side of the doorway when the door is open. Other folding doors have two sets of interconnected panels that store on either side of the doorway when the door opens. To close doors with two sets of panels, both sets unfold and meet at the center of the doorway. Folding doors are often used where there is insufficient space around the doorway for operating other types of doors such as swinging or straight translating doors.

Current folding doors have their limitations and drawbacks. First, when a conventional folding door is closed, its panels and their supporting articulating framework need to be coplanar and lie flat against a wall-mounted seal. But then, as the panels and their framework fold to open the door, portions of the framework need to penetrate or pass through the seal, so the seal needs to be quite forgiving. Consequently, brush seals with yieldable bristles are typically used; however, such seals do not always seal well, and they tend to accumulate frost, which further reduces their sealing ability. To avoid having to use a compliant brush seal, some folding doors eliminate the articulating framework so that the relatively flexible panels can give rather than the seal having to do so. But, without a supporting framework, the flexible panels create a flimsy door that may exert insufficient force to seal against the wall-mounted seal. Moreover, frameless folding doors can be more difficult to operate in a controlled manner.

Second, for doors with folding panels suspended from an articulated framework of pivotally interconnected arms, adjoining arms typically share a common hinge point. When the adjoining arms pivot about the same point, the framework tends not to fold up as snuggly, which can increase the required space needed to stack the panels in their stored position.

Third, when a folding door is closed and all of its interconnecting pivot points are lying in a straight line, the door tends to resist opening until the opening force is sufficient to buckle the series of pivot points out of their collinear alignment.

Fourth, when a drive unit pulls a folding door shut in a direction parallel to the overhead track, the resulting perpendicular force urging the interconnecting pivot points in line approaches zero as the door reaches its closed position. Thus, it can be difficult to force the back face of the door tightly against the wall-mounted seals, such as those commonly found in cold storage applications.

And fifth, folding doors with two sets of panels sharing a common overhead track can be difficult to seal where the leading edges of the panels meet at the center of the doorway.

Consequently, a need exists for a door that overcomes the limitations of current folding doors.

SUMMARY

In some embodiments, the articulated supporting arms of a folding door are pivotally coupled by a connector with different pivot points for each associated arm.

In some embodiments, a folding door includes at least one panel that can pivot relative to its supporting arm.

In some embodiments, a spring urges a panel to pivot relative to the panel's supporting arm.

In some embodiments, a control mechanism affects the pivotal motion of a panel to ensure that the panel is guided into an overlapping relationship with another panel.

In some embodiments of a folding door, two leading panels directly approaching each other are controlled to ensure that the two panel overlap when the door reaches its fully closed position.

In some embodiments of a folding door, a magnet carried by a trolley along an overhead track helps hold the door closed.

In some embodiments of a folding door, a seamless folding member is attached to a series of pivotally interconnected panels to provide a smooth uninterrupted surface between the panels and a wall-mounted seal.

In some embodiments of a folding door, some pivot points of the door travel along a substantially straight line parallel to an overhead track, and other pivot points travel along a curve so that the door can extend and retract in proximity with a wall-mounted seal.

In some embodiments, a folding door seals against a wall-mounted seal that is inflatable.

In some embodiments, the supporting arms are out of coplanar alignment when the door is closed, and the panels associated with the arms are mounted at angles relative to the arms such that the panels are in coplanar alignment when the door is closed.

DESCRIPTION OF AN EMBODIMENT

Figure 1:
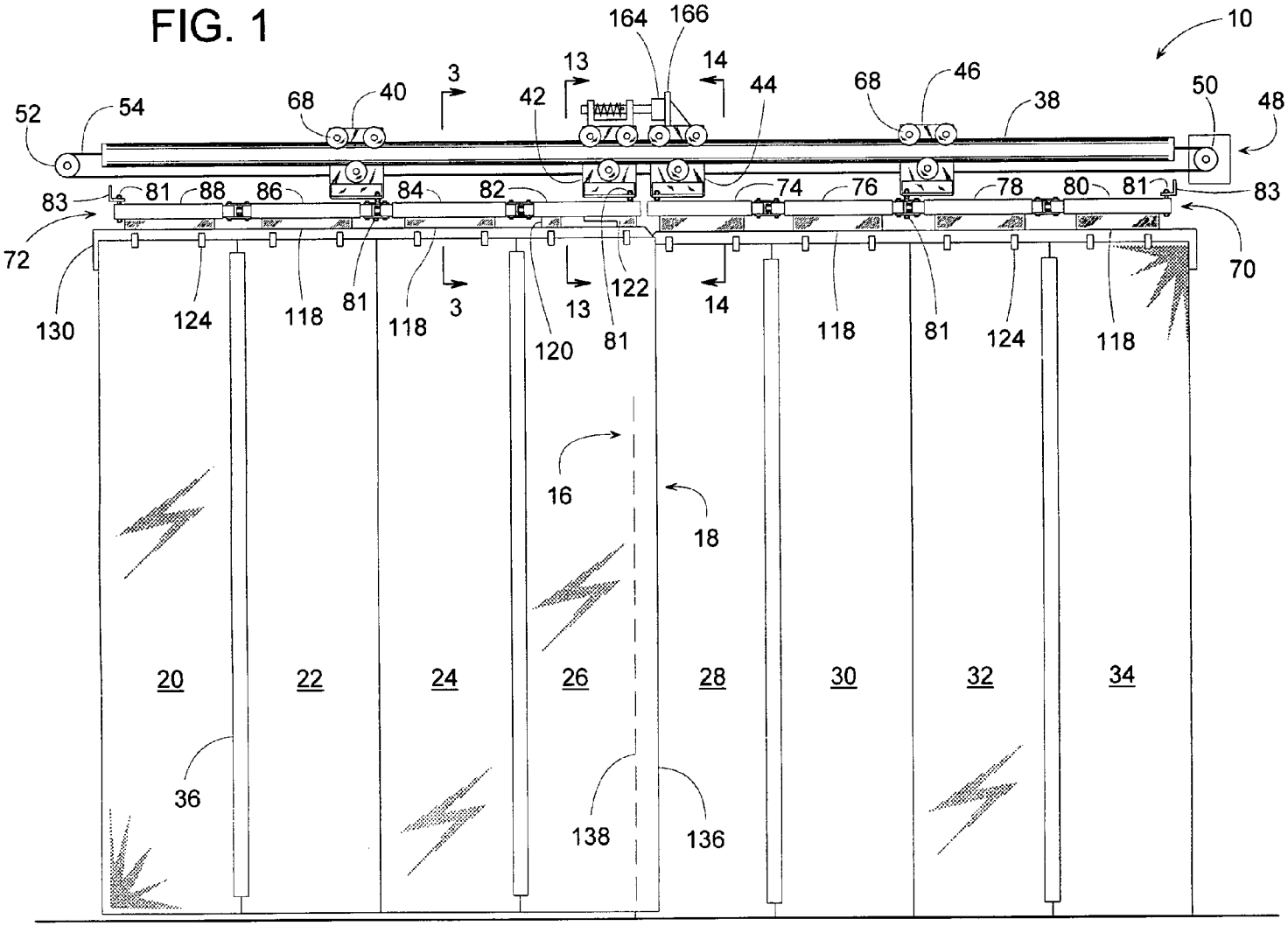
FIG. 1 is a front view of a power-operated folding door shown in its closed position.

A folding door 10 of FIGS. 1-14 includes various features that make the door 10 particularly suited for use at a doorway 12 of a cold storage room; however, the door 10 is readily adapted for other applications as well. Door 10 includes an illustrative relatively airtight seal 14 in the form of an inflatable fabric duct (although other forms of sealing are possible) disposed around the perimeter of doorway 12 and novel mechanisms ensure that door 10 closes sealingly tight and opens readily. Although seal 14 is shown extending along the top and side edges of doorway 12, in some cases, seal 14 only runs along the top of the doorway, and another type of seal is used along the side edges. Door 10 is shown closed in FIG. 1 and open in FIG. 2.

In this particular example, door 10 comprises two sets of vertically elongate panels that can fold upon themselves to open and unfold to close. The door includes a RH (right hand) set of panels 16 and a LH (left hand) set of panels 18. The terms, "RH" and "LH" are simply meant to distinguish one side of the door from the other. The positions of RH and LH door components can actually be at either side of the door, i.e., RH parts could be on the left hand side of the door, and LH parts could be on the right hand side. Although door 10 is shown having both RH and LH door panels 16, 18 that meet near the center of the doorway when the door is closed, it is well within the scope of the invention to have a door with just one set of panels (RH or LH) that store off to one side of the doorway when the door is open and extend fully across the doorway when the door is closed.

Figure 2:
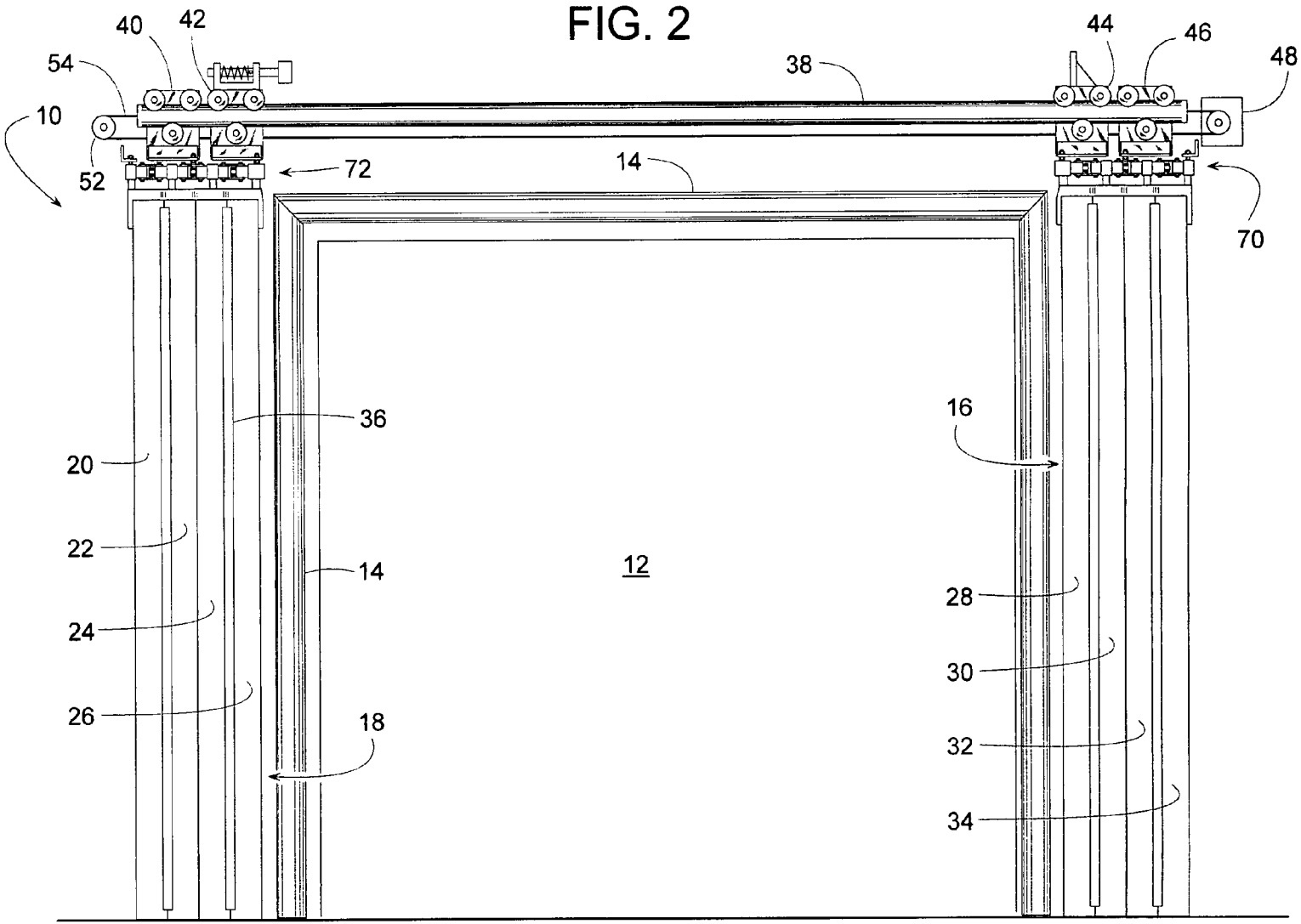
FIG. 2 is a front view similar to FIG. 1 but showing the door open.

For the illustrated example, LH panels 18 include panels 20, 22, 24 and 26; and RH panels 16 include panels 28, 30, 32 and 34. VELCRO® strips 36 or some other appropriate fastener pivotally interconnect adjacent panels along their vertically adjoining edges so that the RH panels 16 and the LH panels 18 can each fold upon themselves and store along either lateral side of doorway 12 when the door is open, as shown in FIG. 2. When door 10 closes, the panels unfold and extend across the doorway with lead panels 26 and 28 overlapping near the center of the doorway.

To enable the panels to fold and unfold across the doorway, the RH panels are suspended from a RH articulated arm assembly 70, and the LH panels are suspended from a LH articulated arm assembly 72. More specifically, articulated assembly 70 comprises a first RH arm 74, a second RH arm 76, a third RH arm 78, and a fourth RH arm 80, which carry RH panels 28, 30, 32 and 34 respectively. Likewise, assembly 72 comprises a first LH arm 82, a second LH arm 84, a third LH arm 86, and a fourth LH arm 88, which carry LH panels 26, 24, 22 and 20 respectively.

Articulated arm assemblies 70 and 72 are supported by track followers, such as trolleys 40, 42, 44 and 46, which travel along an overhead track 38. A bracket 60 and a beam 62, shown in FIG. 3, can be used for mounting the track to a wall 64. Rollers 68 couple the trolleys to track 38, and another roller 66 rolls along beam 62 to help maintain the proper angular orientation of the trolleys relative to track 38.

To power the door, a drive unit 48 comprising, for example, a motor driven sprocket 50, an idler sprocket 52, and a roller chain 54, can be coupled by way of conventional connectors 56 and 58 to selectively move leading trolleys 42 and 44 apart to open the door and toward each other to close the door. Such a drive unit is well known to those of ordinary skill in the art and may assume many variations in design including, but not limited to, drive units employing various pulleys, cables, sheaves, belts, rodless cylinders, etc.

Articulation of assemblies 70 and 72, which is perhaps best illustrated in FIGS. 4-9, can be accomplished by way of similar but not necessarily identical connectors 90 and 92, which pivotally interconnect the various arms. Connectors 90 pivotally connect arm 86 to 88, arm 82 to 84, arm 74 to 76, and arm 78 to 80. And connectors 92 pivotally connect arm 84 to 86 and arm 76 to 78. The connectors are carefully designed to accomplish several important functions which may include, but are not necessarily limited to, pivotally interconnecting the arms of assemblies 70 and 72, coupling the arm assemblies to trolleys 40 and 46, preventing adjoining arms from toggling over center, allowing the assemblies 70 and 72 to fold more compactly, and enabling the door to open more readily and close more tightly.

Figure 13:
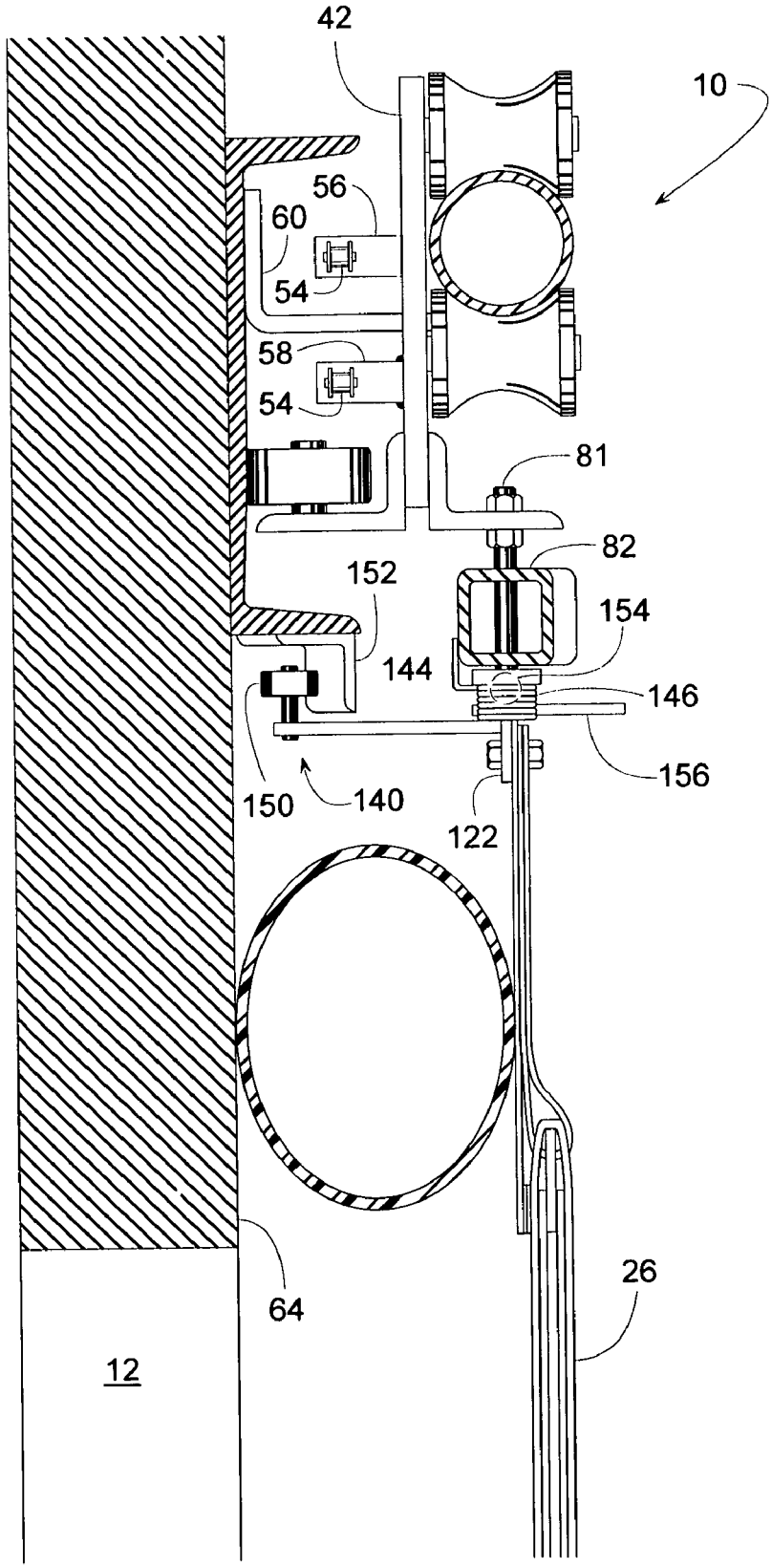
FIG. 13 is a cross-sectional view taken along line 13-13 of FIG. 1.
Figure 14:
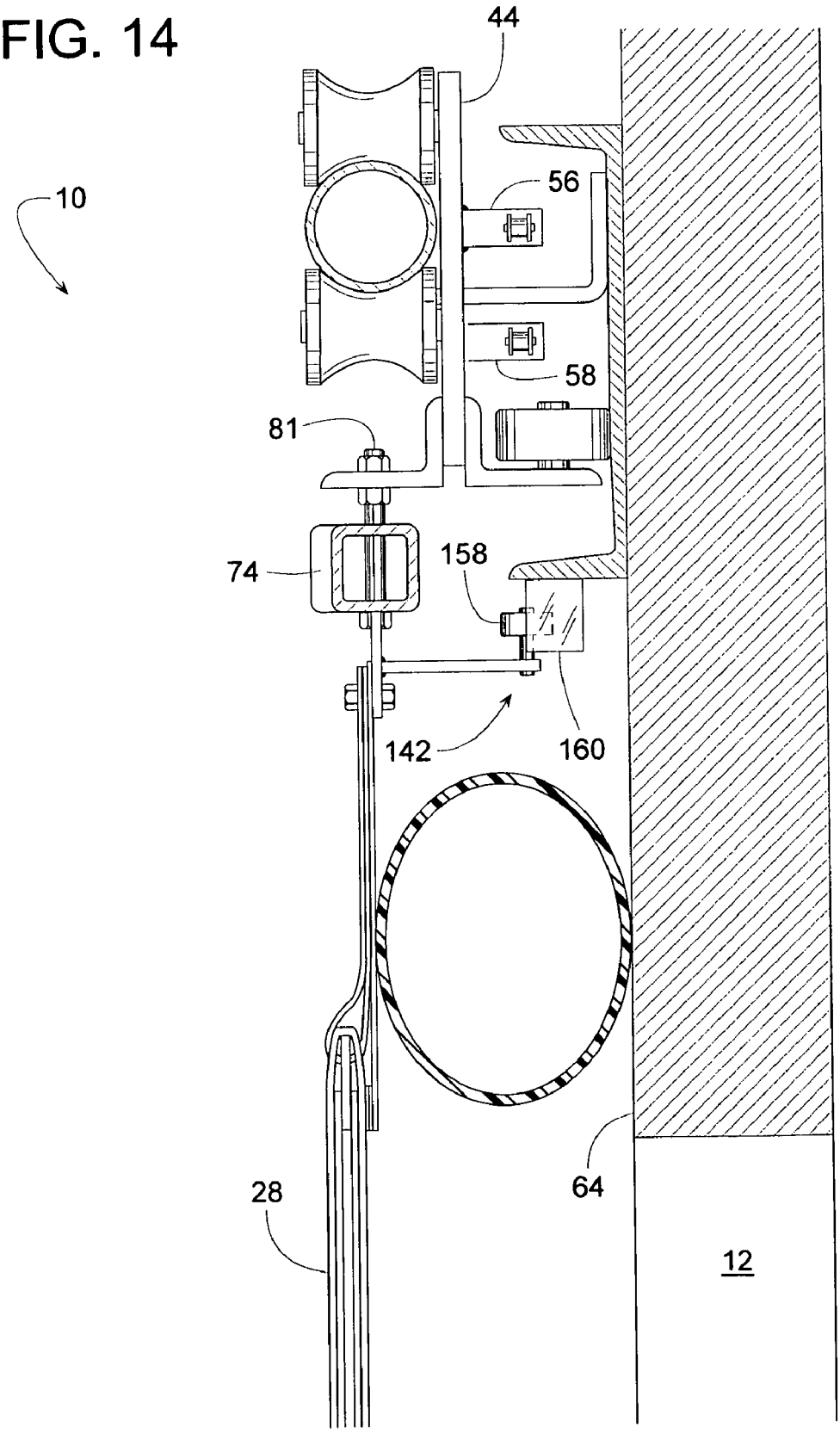
FIG. 14 is a cross-sectional view taken along line 14-14 of FIG. 1.

Referring to FIGS. 13 and 14, to support assemblies 70 and 72 from trolleys 42 and 44, a fastener 81 provides a rotatable supporting connection between arm 82 and trolley 42 and between arm 74 and trolley 44. Fastener 81 can also provide a pivotal connection between a stationary anchor 83 (FIG. 1) and arm 88, and another pivotal connection between a second anchor 83 and arm 80. To further support assemblies 70 and 72 from trolleys 40 and 46, a central hole 79 in connectors 92 (FIGS. 4-9) is adapted to receive a fastener 81. One fastener 81 pivotally connects trolley 40 to the connector 92 that is between arms 84 and 86, and another fastener 81 pivotally connects trolley 46 to the connector 92 that is between arms 76 and 78. As door 10 opens and closes, connectors 90 travel along a curved path 85 (FIG. 11), while the other connectors 92 travel along a collinear path 102 that is generally parallel to track 38.

Figure 5:
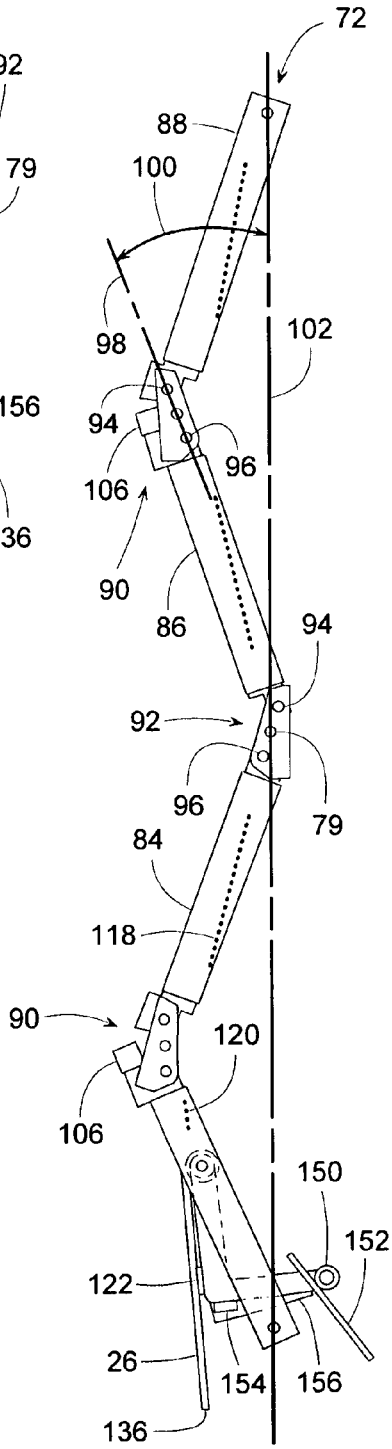
FIG. 5 is a top view similar to FIG. 4 but showing the arm assembly when the door is nearly closed.

To enable the panels to fold up and store more compactly when the door is open, adjoining arms each pivot about a point that is horizontally spaced apart from the other's pivot point, so adjacent panels and their corresponding arms pivot about two separate points rather than sharing a common pivot point. This compact storage configuration can be seen in FIG. 4, in which the various arms are able to assume a near parallel configuration. Such a configuration would not be possible if the arms shared a pivot point on the connector between them, as interference between the arms themselves would prevent the angle between them from being minimized. Structure for allowing this compact storage configuration (and other benefits) can be seen in reference to FIG. 5, in which connectors 90 and 92 each define a first pivot point 94 about which one arm rotates and a second pivot point 96 about which an adjacent arm rotates. In FIG. 5, Panel 22 and arm 86, for instance, pivot about point 94 of connector 92, and panel 24 and arm 84 pivot about point 96.

Figure 6:
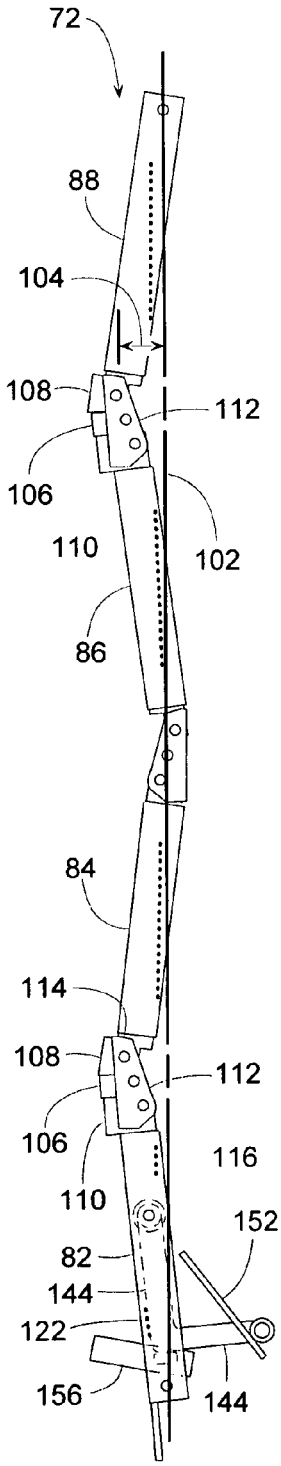
FIG. 6 is a top view similar to FIGS. 4 and 5 but showing the arm assembly when the door is completely closed.
Figure 8:
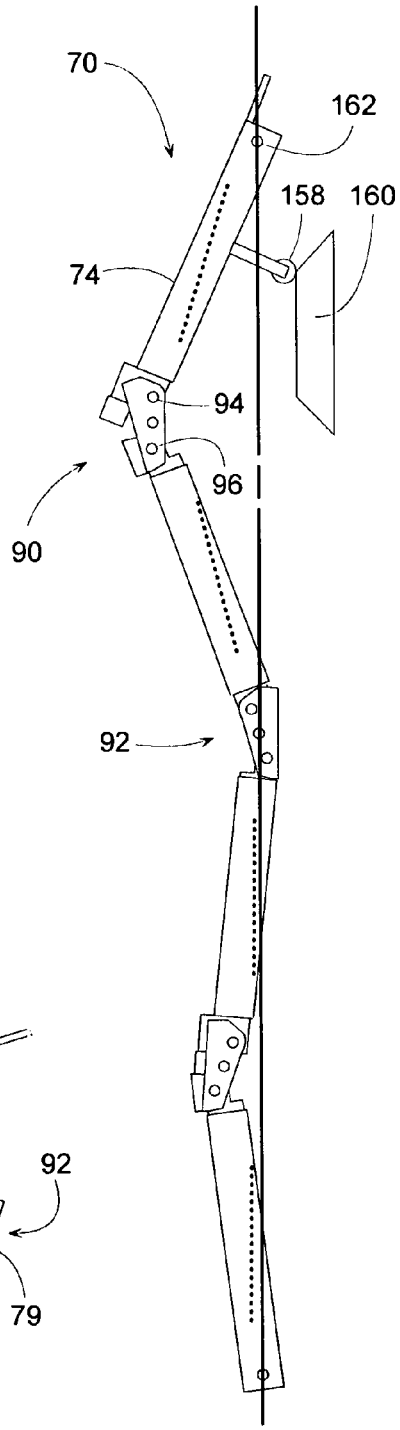
FIG. 8 is a top view similar to FIG. 7 but showing the arm assembly when the door is nearly closed.
Figure 9:
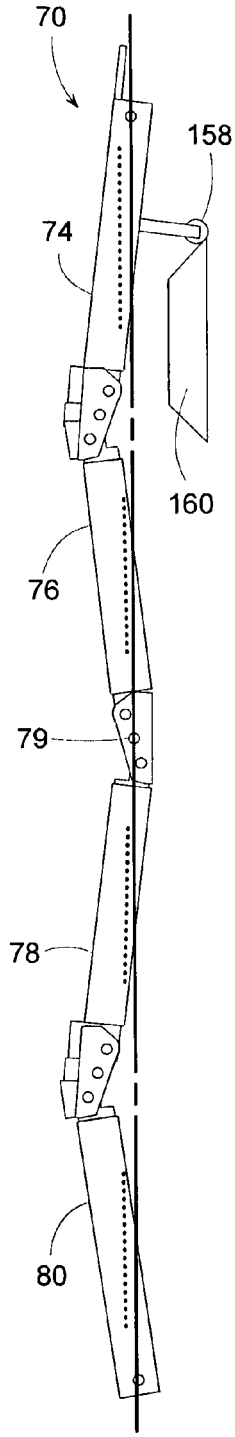
FIG. 9 is a top view similar to FIGS. 7 and 8 but showing the arm assembly when the door is completely closed.
Figure 7:
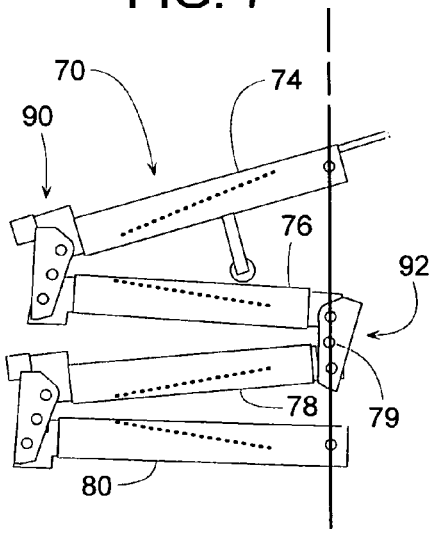
FIG. 7 is a top view of a RH arm assembly as shown when the door is open.

Moreover, to prevent the panels from toggling over center when the door is closed (thus making it difficult to subsequently open the door), the two pivot points 94 and 96 define a line 98 that lies at an angle 100 (i.e., not parallel) to a centerline 102 of track 38 when door 10 is closed. With line 98 being at an angle to track 38, a rotational door-opening moment is created between adjacent panels when drive unit 48 pulls trolleys 42 and 44 away from each other along track 38. In a similar vein, when door 10 is closed, as shown in FIG. 6, at least one of points 94 and 96 is preferably displaced a slight distance 104 out of collinear alignment with the track's centerline 102 to initiate buckling of assemblies 70 and 72 as drive unit 48 begins opening the door.

The angular orientation 100 of pivot points 94 and 96 and or the offset distance 104 of the connectors 90 can be achieved by various means including, but not limited to, installing a shock-absorbing bumper 106 that limits the relative rotation between adjoining arms. In some embodiments, for example, connector 90 comprises one end piece 108 (FIG. 6) extending from arm 84 and another end piece 110 extending from arm 82, wherein bumper 106 is attached to end piece 110 and becomes pinched between pieces 108 and 110 when arms 82 and 84 straighten out as the door closes. The actual shape of the various end pieces may vary from one arm to the next to achieve the necessary clearance between adjoining arms.

As an alternative or in addition to bumper 106, connectors 90 and 92 may include upper and lower connecting plates 112 (FIG. 10), which are pivotally pinned to end pieces 108 and 110, which can be of a shape and size that limits the pivotal motion between arms 82 and 84. More specifically, edges 114 and 116 of plates 112 can be such that with sufficient relative pivotal motion between arms 82 and 84, the plate edges 114 and 116 abut the ends of arms 82 and 84 to restrict further pivotal motion of the arms.

This structure for assemblies 70 and 72 provides the previously described benefits, including at least the compact storage configuration, and prevention of the arms of the assembly from toggling over center in the closed position. It will be apparent from consideration of FIG. 6, however, that these benefits come at the price of the assemblies 70, 72 having their various arms out of alignment with each other when the door is in the closed position. If the panels associated with these arms were mounted parallel to the center lines of the individual arms, as is customary, the panels would also be out of alignment with each other when the door was closed. This would make sealing of the door very difficult as there would not be an uninterrupted flat surface to seal against. To compensate for this aspect of the design of assemblies 70, 72 the panels associated with the individual arms of assemblies 70, 72 are mounted at appropriate angles relative to those arms with the result that the panels are in substantially coplanar alignment despite the non-alignment of the arms themselves. This solution can be seen most clearly in FIGS. 6 and 9—showing arms 82, 84, 86, 88 and 74, 76, 78, 80 in their non-aligned configuration, but depicting the associated panels in a dotted line representation. Each panel is mounted at such an angle relative to its associated arm, that the panels assume a substantially co-planar arrangement when the door is closed. The co-planar arrangement of the panels gives a flat, continuous surface beneficial for sealing as described below.

Figure 3:
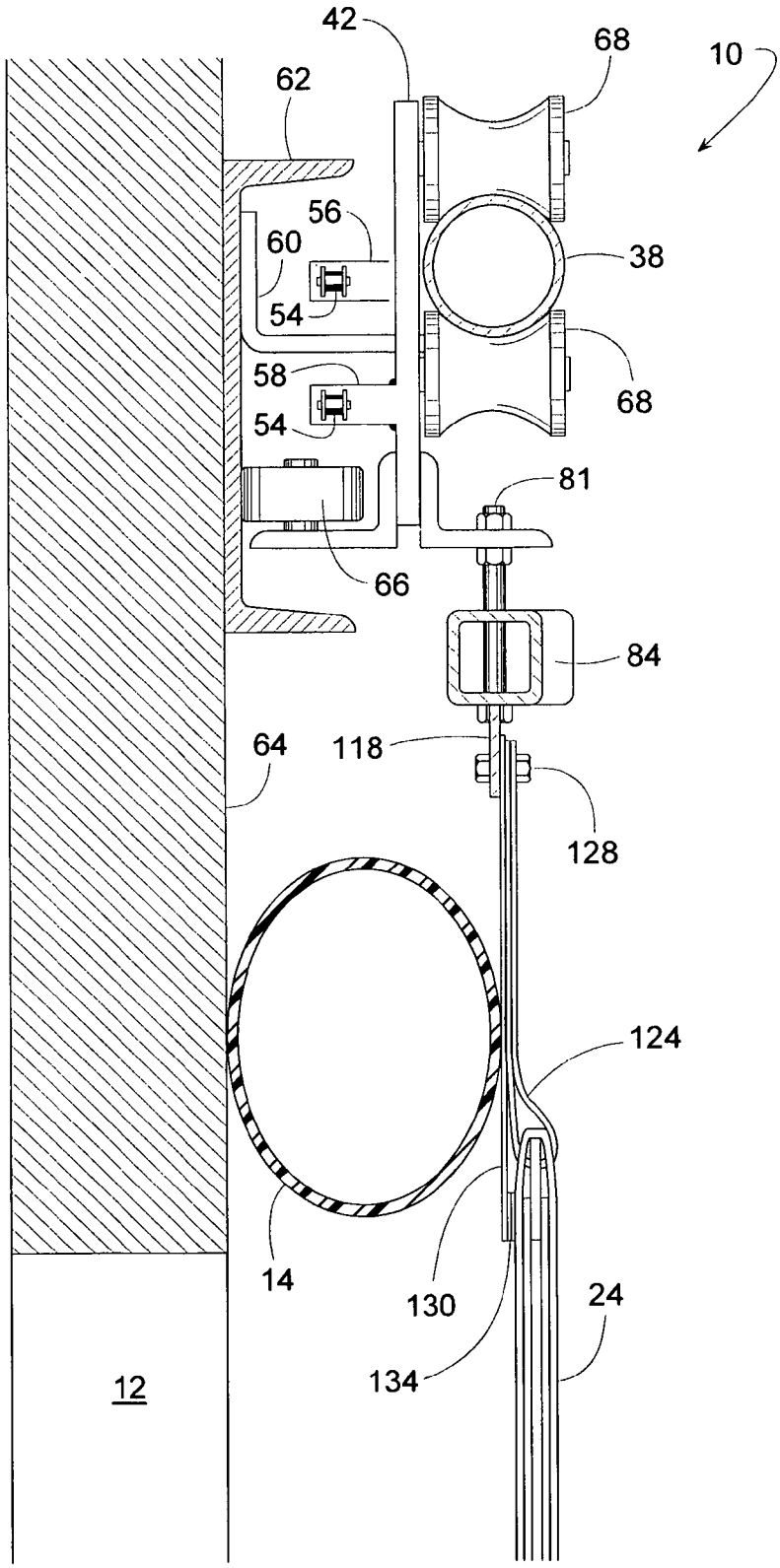
FIG. 3 is a cross-sectional view taken along line 3-3 of FIG. 1.
Figure 4:
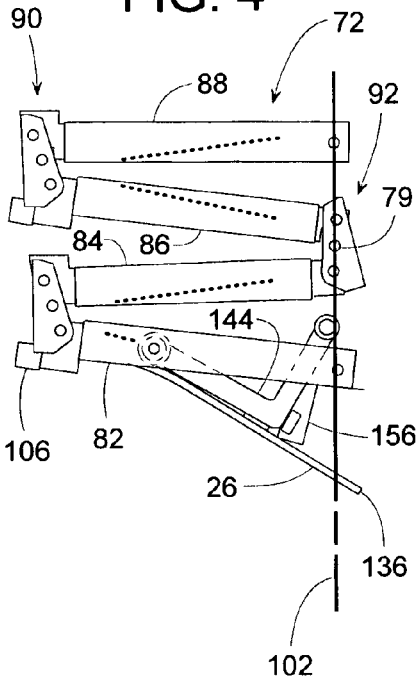
FIG. 4 is a top view of a LH arm assembly as shown when the door is open.
Figure 10:
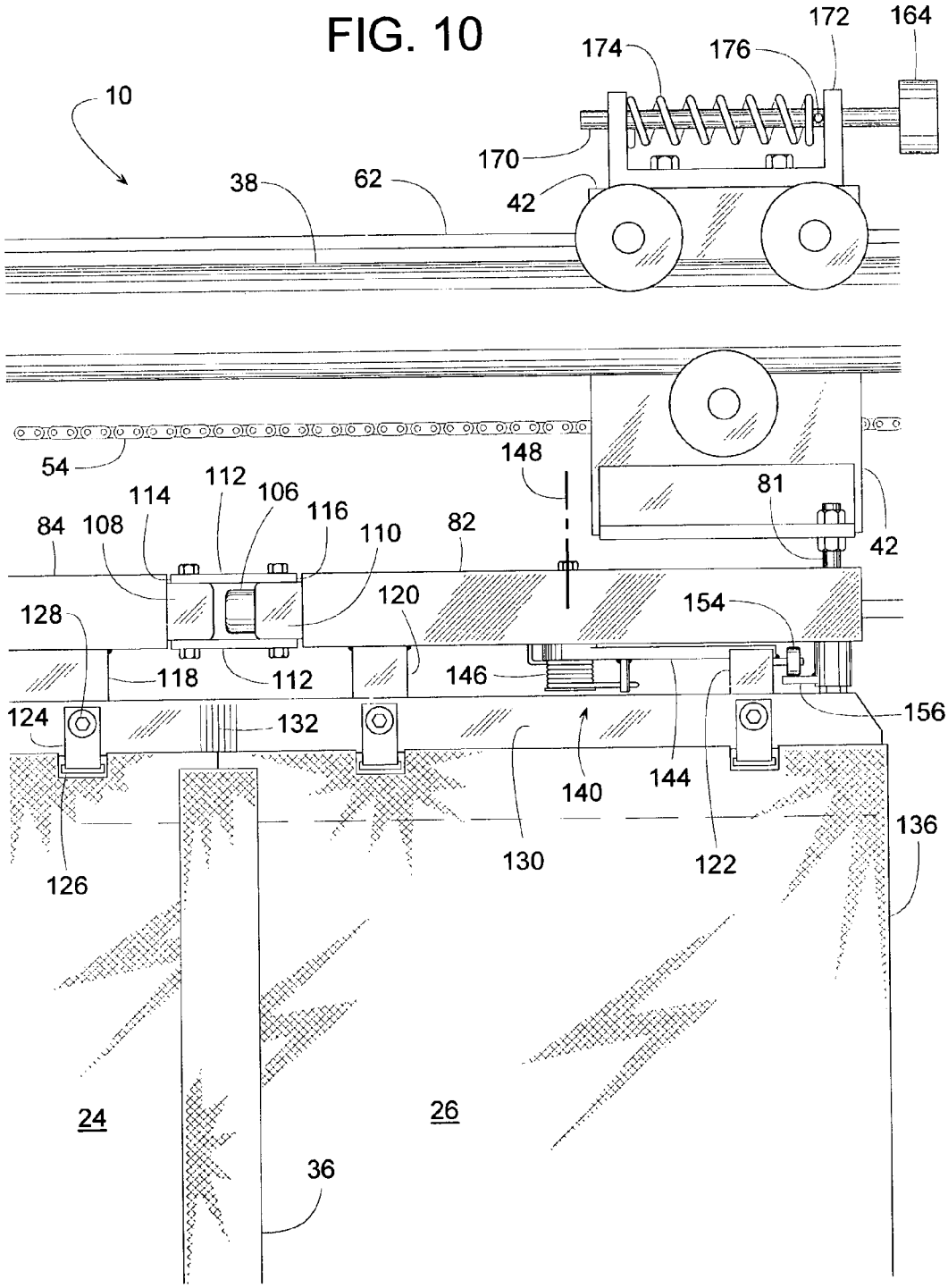
FIG. 10 is a front view of an upper right hand corner of the LH portion of the folding door shown in FIGS. 1 and 2.
Figure 11:
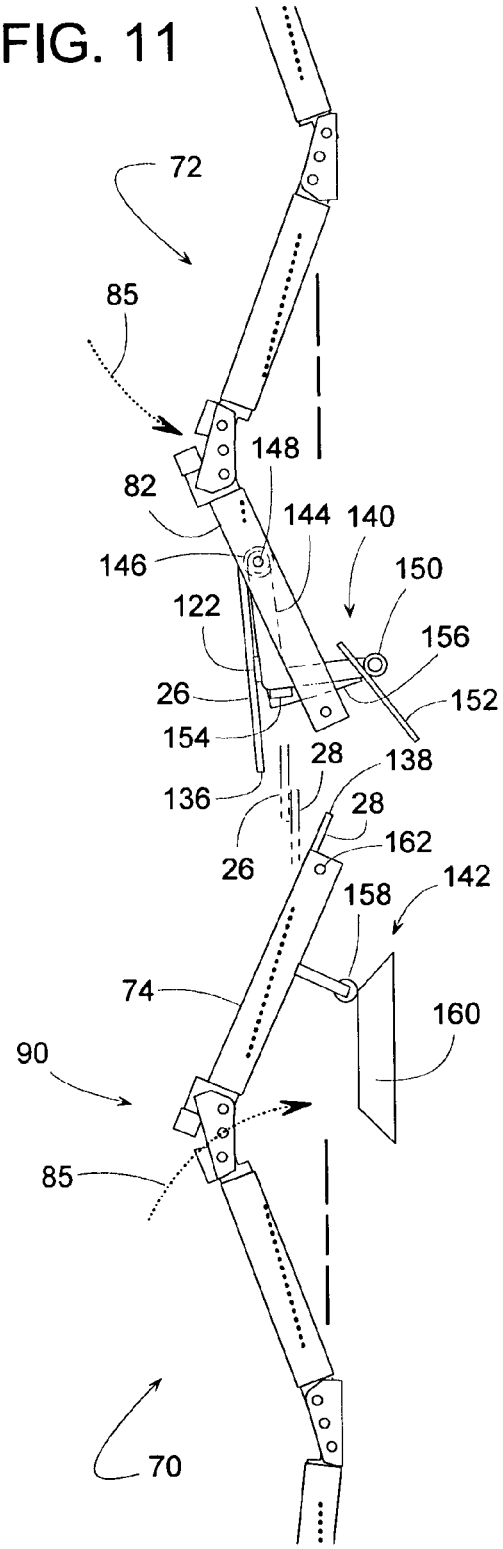
FIG. 11 is a top view showing the RH and LH arm assemblies near their closed position.

Attaching the panels to arm assemblies 70 and 72 can be accomplished by any suitable manner. In some embodiments, as shown in FIGS. 3 and 10, bars 118, 120 and 122 are welded to the underside of the arms, and straps 124 suspend the panels from those bars. Each strap 124 can be looped through an opening 126 in the panels, and a fastener 128 can attached the upper ends of strap 124 to bars 118, 120 or 122. The structure of the panels may be of any suitable design, including but not limited to a panel having a layered and/or insulated core with a tough, wear-resistant cover.

To effectively seal the gap between door 10 and wall 64, seal 14 engages a two-ply folding member 130 that extends vertically between the door panels and their supporting bars (e.g., between panel 24 and bar 118 of FIG. 3). Some inconsequential vertical clearance between the upper edge of folding member 130 and the lower edge of the articulated arms may exist; however, this is not necessarily the case. Folding member 130 may advantageously be provided with integral living hinges 132 (FIG. 10) for allowing member 130 to follow the folding motion of arm assemblies 70 and 72 and for creating a relatively smooth sealing surface that extends substantially the full horizontal width of each set of panels 16 and 18. A hook-and-loop fastener 134 (FIG. 3), such as VELCRO®, may be used for connecting a lower edge of member 130 to panel 24. Seal 14 is preferably an inflatable tube; however, foam pads and other types of seals are well within the scope of the invention. Also, the seal could be mounted to member 130 rather than being mounted to the wall. Although, seal 14 could be a brush, such a seal is not required with door 10 because articulated assemblies 70 and 72 control the folding path of member 130 in such a way that member 130 does not have to pass through the seal as is the case with conventional folding doors. In some cases, the side edges of the doorway can be sealed by attaching seal members directly to wall 64 and the outer edges of panels 20 and 34. This is possible because the outer edges of panels 20 and 34 are relatively stationary, except from some pivotal motion about fasteners 81.

Figure 12:
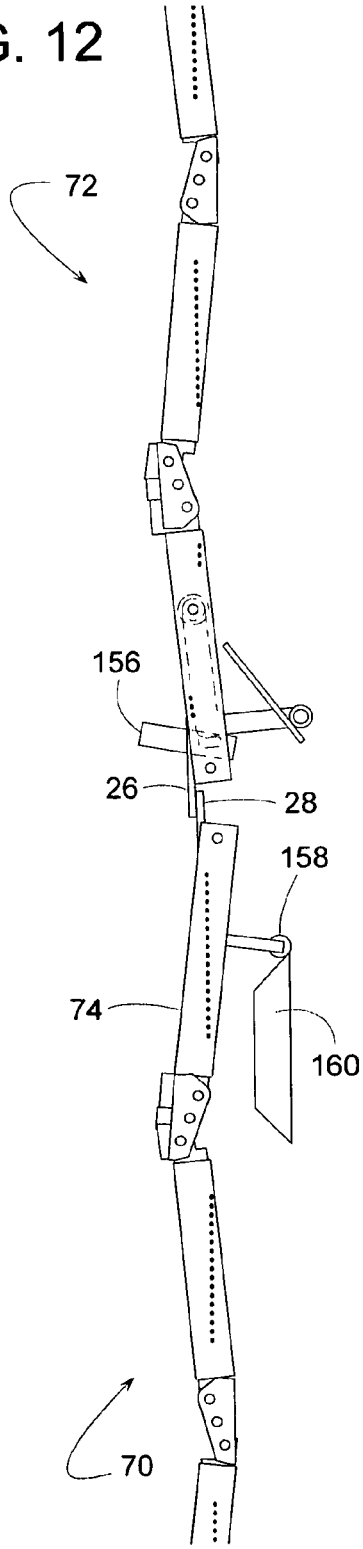
FIG. 12 is a top view similar to FIG. 11 but showing the RH and LH arm assemblies when the door is completely closed.

Sealing between the leading edges 136 and 138 of panels 26 and 28 may be made more reliable by use of control mechanisms 140 and/or 142 which are designed to guide the leading panels 26 and 28 into proper overlapping engagement with each other as the door closes, whereby the door comes to a sealing closed position. The control mechanisms 140 and/or 142 achieve this by altering the paths traveled by end panels 26 and 28, as compared to the paths that would be taken by these panels if they were simply fixed to their support arms, and these support arms traveled their normal paths. In that situation, the ends of the panels 26, 28 would run the risk of abutting head on, since they basically would both be headed to the same point. Instead, and according to this aspect of the invention, the orientation and positions of the lead panels 26, 28 are controlled by the control mechanisms 140, 142 such that their leading edges 136, 138 come together in and overlapping configuration, as depicted in FIG. 12. Control mechanisms 140 and 142 are further illustrated in FIGS. 13 and 14 respectively. The term, "overlapping" refers to one member overlying another as viewed in a direction perpendicular to wall 64 as if looking through the doorway. The term, "control mechanism" broadly refers to any linkage, actuator, or apparatus that employs pivoting, rolling, sliding or similar means of control to help determine the path of a moving door-related component.

Although the actual construction and function of control mechanisms 140 and 142 may vary widely, in a one embodiment, control mechanism 140 comprises a spring-loaded swinging arm 144 that couples bar 122 to arm 82, which can be seen in FIGS. 10-13. A torsion spring 146 acting between swinging arm 144 and arm 82 urges swinging arm 144, bar 122 and leading panel 26 (mounted generally coplanar with bar/22) outward or generally away from wall 64 and/or in a clockwise direction relative to arm 82 in the sense of FIG. 11. In doing so, panel 26 pivots about a substantially vertical axis 148. In this particular embodiment, panel 26 is the only panel that pivots relative to its supporting arm. Spring 146 pushes panel 26 to its outwardly displaced position of FIG. 11 until just before the door closes completely. As door 10 closes from its position of FIG. 11 to that of FIG. 12, a roller 150 attached to swinging arm 144 engages stationary cam member 152, which draws leading edge 136 of panel 26 into overlapping engagement with leading edge 138 of panel 28. To provide swinging arm 144 with additional vertical support at its distal end, a roller 154 can be attached to swinging arm 144, wherein roller 154 rolls along a support bar 156 rigidly coupled to arm 82. In this way, panel 26 is held away from its final orientation relative to arm 82 (and this relative to panel 28) by spring 146, until it is guided to its final orientation at the last moment by interaction with other elements of the guide mechanism 140, such as cam member 152.

To further ensure that panels 26 and 28 overlap each other rather than their leading edges 136 and 138 abutting as the door closes, control mechanism 142 holds arm 74 and associated panel 28 away from its unguided, final orientation until just prior to door 10 closing. This helps ensure that leading edge 138 repeatably tucks in behind leading edge 136 of panel 26 as the door closes, to give a reliable seal. To accomplish this, a roller 158 rigidly coupled to arm 74 engages a stationary cam member 160 when the door is near its closed position. Roller 158 traveling over cam member 160 forces arm 74 and panel 28 to pivot about point 162, whereby edge 138 moves towards the doorway. As roller 158 reaches the end of cam member 160, as shown in FIG. 12, arm 74 and panel 28 pivot back to place the leading edge of panel 28 in overlapping relationship with panel 26. In effect, the control mechanism thus delays panel 28 from achieving a flat orientation (parallel to the plane of the doorway) as compared to the timing of that orientation without the control mechanism. Taken together, the two control mechanisms prevent the leading edges from moving toward one another (in a direction in and out of the doorway) until such time as they will be properly overlapped when they do move toward one another.

Once door 10 is closed, a magnet 164 coupled in some manner and location to one of the trolleys can help hold the door tightly shut with folding member 130 pressed against seal 14. Magnet 164, for example, can be mounted to trolley 42, and a ferrous plate 166 can be attached to trolley 44 such that magnet 164 engaging plate 166 inhibits trolleys 42 and 44 from drifting apart from one another after drive unit 48 is de-energized. To provide magnet 164 and plate 166 with some shock absorption as the two come together, magnet 164 or plate 166 can be movably mounted to its trolley. Magnet 164, for example, can be attached to a rod 170 (FIG. 10), which in turn can slide axially along a support bracket 172 coupled to trolley 42. A compression spring 174 urges magnet 164 towards plate 166. A stop member 176 attached to rod 170 limits the distance that rod 170 can slide within bracket 172. With such an arrangement, or the equivalent thereof, the compressibility of spring 174 and the relative sliding between rod 170 and bracket 172 can absorb the shock of the sudden engagement between magnet 164 and plate 166, which might otherwise be a hard impact when the door closes.

Although the invention is described with reference to a various embodiments, it should be appreciated by those of ordinary skill in the art that various modifications are well within the scope of the invention. In some embodiments, for example, magnets can be used for interacting with assemblies 70 and 72 to delay the extension of arms 78, 80, 86 and 88 as the door begins to close, thereby ensuring that arms 74, 76, 82 and 84 are first to extend and are relatively straight when rollers 150 and 158 engage their respective cam members 152 and 160. Therefore, the scope of the invention is to be determined by reference to the following claims:

We claim:

1. A folding door adjacent a doorway and movable between an open position and a closed position, the folding door comprising:

an overhead track;

a track follower movable along the overhead track;

a first arm supported by the track follower;

a second arm pivotally coupled to the first arm;

a first panel coupled to the first arm at a fixed non-zero angle relative thereto; and a second panel coupled to the second arm at a fixed non-zero angle relative thereto;

wherein the first panel and the second panel are substantially coplanar when the door is in the closed position;

wherein the first arm is neither parallel nor coplanar relative to the second arm when the door is in the closed position.

2. The folding door of claim 1, wherein the first and second arms are substantially parallel when the door is in the open position.

3. The folding door of claim 1, further comprising a seal disposed adjacent to the doorway and a folding member extending vertically from the first arm to the first panel and extending horizontally from the first panel to the second panel, wherein the folding member engages the seal when the folding door is closed, and the folding member folds upon itself when the folding door is open.

4. The folding door of claim 3, wherein the seal is an inflatable seal.

5. The folding door of claim 1, further comprising a connector that pivotally couples the first arm to the second arm.

6. The folding door of claim 5, wherein the connector defines a first pivot about which the first arm rotates and a second pivot point about which the second arm rotates, wherein the first pivot point and the second pivot point are horizontally spaced apart from each other at a substantially fixed distance.

7. The folding door of claim 6, wherein the first pivot point and the second pivot point define a line that lies at an angle to the overhead track when the door is in the closed position.

8. The folding door of claim 6, wherein the overhead track has a centerline, and at least one of the first or second pivot points are displaced out of alignment with the centerline when the door is closed.

9. A folding door adjacent to a doorway, the folding door comprising:

an overhead track;

a first panel assembly supported by the overhead track;

a second panel assembly supported by the overhead track;

a drive unit coupled to the first and the second panel assemblies to forcibly move the panel assemblies between an open position and a closed position, wherein the first panel assembly is separated from the second panel assembly in the open position and the first panel assembly contacts and at least partially overlaps the second panel assembly in the closed position; and a control mechanism that controls the angle of the first panel assembly relative to the second panel assembly as the panel assemblies move from the open position to the closed position to prevent the first panel assembly from becoming substantially parallel to the doorway until the first panel assembly is in a position to overlap the second panel assembly.

10. The folding door of claim 9, wherein the control mechanism guides the first panel assembly to prevent the first panel assembly from abutting head-on the second panel assembly as the door moves to the closed position.

11. The folding door of claim 10, wherein the first panel assembly is coupled to an arm, and the control mechanism comprises a roller fixed to the arm that engages a stationary cam as the door approaches the closed position, the engagement delaying the time at which the first panel assembly assumes a position parallel to the plane of the doorway.

12. The folding door of 10 wherein the first panel assembly is coupled about a substantially vertical axis to a first arm, and the control mechanism comprises:

a spring for biasing the panel to a first, rotated orientation relative to the first arm;

a swinging arm coupled to the first panel assembly for moving the first panel assembly relative to the first arm; and a fixed cam engaged by the swinging arm as the door approaches the closed position to move the first panel assembly to a second, unrotated orientation relative to the first arm.

13. A method of assembling a folding door, comprising:

providing first and second articulated arms movable along an overhead track between an open position in which the first articulated arm is substantially parallel to the second articulated arm and a closed position in which the first articulated arm is non-coplanar with the second articulated arm; and compensating for the non-coplanar alignment of the first articulated arm and the second articulated arm in the closed position by mounting a door panel to each articulated arm at a fixed non-zero angle relative to the respective articulated arm and the fixed non-zero angle selected to dispose the panels in coplanar alignment with one another in the closed position.

14. A folding door adjacent a doorway and movable between an open position and a closed position, the folding door comprising:

an overhead track;

a track follower movable along the overhead track;

a first arm supported by the track follower;

a second arm;

a first panel coupled to the first arm at a fixed non-zero angle relative thereto;

a second panel coupled to the second arm at a fixed non-zero angle relative thereto, wherein the first panel and the second panel are substantially coplanar when the door is in the closed position;

wherein the first arm is neither parallel nor coplanar relative to the second arm when the door is in the closed position;

a connector pivotally coupled to the first arm at a first pivot point and pivotally coupled to the second arm at a second pivot point that is different from the first pivot point, wherein the first pivot point and the second pivot point define a line that lies at a non-zero angle relative to the overhead track when the door is in the closed position and wherein the connector enables the first arm and the second arm to have a nonparallel relationship to the first and second panels when the door is in the closed position.

* * * * *

UNITED STATES PATENT AND TRADEMARK OFFICE

CERTIFICATE OF CORRECTION

PATENT NO. : 7,699,089 B2
APPLICATION NO. : 11/435952
DATED : April 20, 2010
INVENTOR(S) : Knutson et al.

It is certified that error appears in the above-identified patent and that said Letters Patent is hereby corrected as shown below:

Column 8, line 43 (claim 9), after "mechanism" insert --comprising a roller fixed to an arm--.

Column 9, line 5 (claim 13), after "assembling" delete "a" and insert --the--. After "door" insert --of claim 1--.

Signed and Sealed this

Sixth Day of July, 2010

David J. Kappos

David J. Kappos
*Director of the United States Patent and Trademark Office*